US005154572A

United States Patent [19]

Toyoshima et al.

[11] Patent Number: 5,154,572

[45] Date of Patent: Oct. 13, 1992

[54] VACUUM PUMP WITH HELICALLY THREADED CYLINDERS

[75] Inventors: Takeshi Toyoshima, Ibaraki; Mitsuo Ogura, Katsuta, both of Japan

[73] Assignee: Hitachi Koki Company Limited, Tokyo, Japan

[21] Appl. No.: 649,766

[22] Filed: Jan. 25, 1991

[30] Foreign Application Priority Data

Jan. 26, 1990 [JP] Japan ..... 2-17213

[51] Int. Cl.[5] ..... F01D 1/36

[52] U.S. Cl. ..... 415/90

[58] Field of Search ..... 415/90; 417/423.4

[56] References Cited

U.S. PATENT DOCUMENTS

| | | | |
|---|---|---|---|
| 1,810,083 | 1/1931 | Norinder . | |
| 2,730,297 | 1/1956 | Van Dorsten et al. . | |
| 4,732,529 | 3/1988 | Narita et al. | 415/90 |
| 4,732,530 | 3/1988 | Ueda et al. | 415/90 |
| 4,735,550 | 4/1988 | Okawada et al. . | |
| 4,797,062 | 1/1989 | Deters et al. | 415/90 |
| 4,806,074 | 2/1989 | Burger et al. | 415/90 |
| 4,822,251 | 4/1989 | Amrath et al. | 415/90 |
| 4,826,393 | 5/1989 | Miki | 415/90 |
| 4,893,985 | 1/1990 | Holss | 415/90 |
| 4,929,151 | 5/1990 | Long et al. | 415/90 |

FOREIGN PATENT DOCUMENTS

| | | | |
|---|---|---|---|
| 260733 | 3/1988 | European Pat. Off. | 415/90 |
| 2409857 | 9/1975 | Fed. Rep. of Germany | 415/90 |
| 3317868 | 11/1984 | Fed. Rep. of Germany . | |
| 3526517 | 2/1986 | Fed. Rep. of Germany . | |
| 887499 | 11/1943 | France . | |
| 2619867 | 3/1989 | France . | |

*Primary Examiner*—John T. Kwon

*Attorney, Agent, or Firm*—Pollock, VandeSande & Priddy

[57] ABSTRACT

A vacuum pump includes a rotatable cylinder rotatably disposed coaxially around an inner stationary cylinder and in an outer stationary cylinder. The rotatable cylinder has a plurality of recesses defined in inner and outer circumferential surfaces thereof. The outer stationary cylinder has a helical groove defined in an inner circumferential surface thereof. The inner stationary cylinder has a helical groove defined in an outer circumferential thereof. The rotatable cylinder is rotated by a motor to deliver a gas axially along the helical grooves. The recesses are effective to produce turbulent flows in the gas to increase the rate at which the gas is discharged. The recesses have an axial length smaller than the transverse width of helical threads on the outer circumferential surface of the inner stationary cylinder and the inner circumferential surface of the outer stationary cylinder, to minimize any gas leakage across the helical threads.

4 Claims, 2 Drawing Sheets

VACUUM PUMP WITH HELICALLY THREADED CYLINDERS

BACKGROUND OF THE INVENTION

1. Field of the Invention

The present invention relates to a vacuum pump which operates to deliver a gas from the inlet side to the exhaust side under conditions ranging from viscous flow conditions to molecular flow conditions, and more particularly to a vacuum pump composed of helically threaded cylinders, which is capable of developing high back pressure.

2. Prior Art

One typical molecular drag pump for discharging a gas comprises helically threaded cylinders. Such a molecular drag pump is relatively simple in construction and can relatively easily be manufactured, but is disadvantageous in that it develops only relatively low back pressure. More specifically, the radial gap defined between a rotatable cylinder and an outer stationary cylinder disposed therearound, and the radial gap defined between the rotatable cylinder and an inner cylinder disposed therein, allow the gas to leak therethrough. Because of the gas leakage through these radial gaps, the back pressure developed by the pump is relatively low. Therefore, it has been customary to employ a roughing pump such as a hydraulically operated vacuum pump to reduce the pressure at the outlet side of the molecular drag pump down to a pressure level ranging from 1 to 100 Torr.

SUMMARY OF THE INVENTION

In view of the aforesaid drawbacks of the conventional molecular drag pump, it is an object of the present invention to provide a vacuum pump with helically threaded cylinders which can deliver a gas from the inlet side to the outlet side which is held under the atmospheric pressure, so that no roughing pump will be necessary for use with the vacuum pump.

According to the present invention, a vacuum pump includes a rotatable cylinder rotatably disposed coaxially around an inner stationary cylinder and in an outer stationary cylinder. The rotatable cylinder has a plurality of recesses defined in at least one of inner and outer circumferential surfaces thereof. The outer stationary cylinder has a helical groove defined in an inner circumferential surface thereof. The inner stationary cylinder has a helical groove defined in an outer circumferential thereof. The rotatable cylinder is rotated by a motor to deliver a gas axially along the helical grooves. The recesses are effective to produce turbulent flows in the gas to increase the rate at which the gas is discharged. The recesses have an axial length smaller than the transverse width of a helical thread on the outer circumferential surface of the inner stationary cylinder or the inner circumferential surface of the outer stationary cylinder, to minimize any gas leakage across the helical thread.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
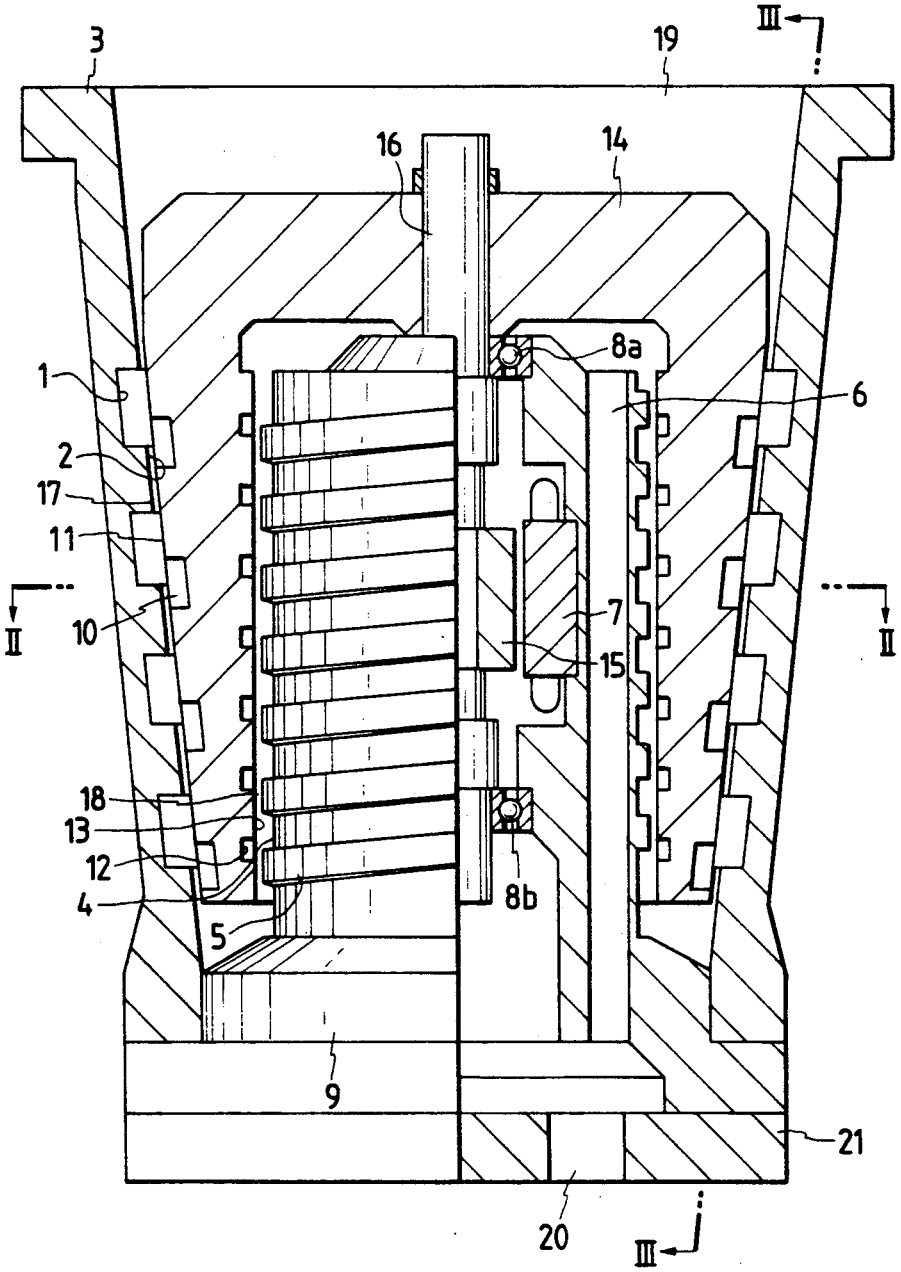
FIG. 1 is an axial cross-sectional view of a vacuum pump according to the present invention.
Figure 2:
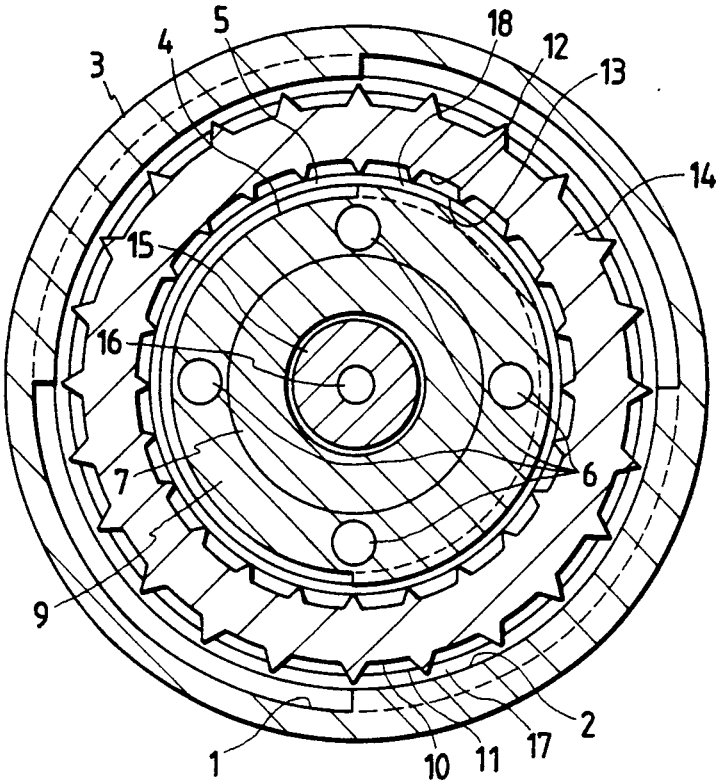
FIG. 2 is a cross-sectional view taken along line II—II of FIG. 1.
Figure 3:
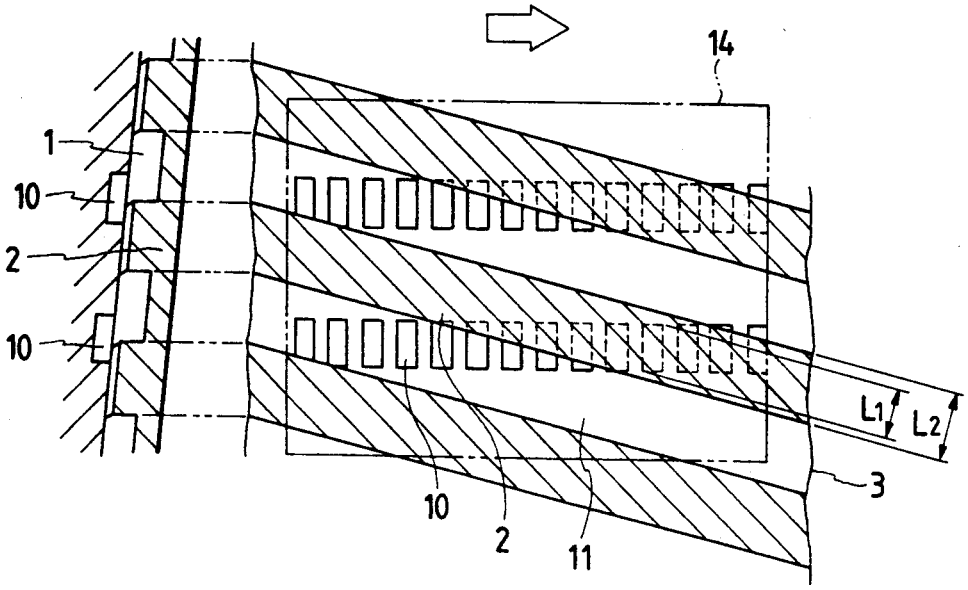
FIG. 3 is an enlarged fragmentary cross-sectional view taken along line III—III of FIG. 2.

FIGS. 1, 2, and 3 show a vacuum pump according to the present invention. As shown in FIGS. 1 and 2, the vacuum pump comprises a hollow rotatable cylinder 14 coaxially mounted on a rotor shaft 16. The rotatable cylinder 14 is fixed to an upper end of the rotor shaft 16, which is rotatably supported by bearings 8*a*, 8*b* in a hollow inner stationary cylinder 9 fixedly mounted at one axial end on a base 21 spaced from an axial end of the hollow rotatable cylinder 14. The rotatable cylinder 14 is rotatable at constant speed in the direction indicated by the arrow A (FIG. 3). The vacuum pump also includes a hollow outer stationary cylinder 3 disposed coaxially around the rotatable cylinder and fixedly mounted on the inner stationary cylinder 9 near the base 21.

The outer stationary cylinder 3 is of a conical configuration, and the rotatable cylinder 14 has a conical outer surface complementarily facing the outer stationary cylinder 3. The outer stationary cylinder 3 has a helical groove 1 defined in an inner circumferential surface thereof and a helical rib or thread 2 on the inner circumferential surface. The inner stationary cylinder 9 has a helical groove 4 defined in an outer circumferential surface thereof and a helical rib or thread 5 on the outer circumferential surface. The inner stationary cylinder 9 also has axial discharge holes 6 extending from one axial end to the other axial end thereof.

A motor for rotating the rotor shaft 16 comprises a stator 7 supported on an inner circumferential surface of the inner stationary cylinder 9 and a rotor 15 mounted on the rotor shaft 16 in radially facing relation to the stator 7.

The rotatable cylinder 14 has a plurality of axially spaced circumferential rows of recesses 10 defined in an outer circumferential surface thereof and a plurality of axially spaced circumferential smooth lands 11 on the outer circumferential surface. The rows of recesses 10 and the smooth lands 11 axially alternate with each other. The rotatable cylinder 14 also has a plurality of axially spaced circumferential rows of recesses 12 defined in an inner circumferential surface thereof and a plurality of axially spaced circumferential smooth lands 13 on the inner circumferential surface. The rows of recesses 12 and the smooth lands 13 axially alternate with each other.

The rotatable cylinder 14 is thus radially positioned between the outer and inner stationary cylinders 3, 9. The helical thread 2 on the inner circumferential surface of the outer stationary cylinder 3 and the smooth lands 11 on the outer circumferential surface of the rotatable cylinder 14 jointly define a gap 17 therebetween. The helical thread 5 on the outer circumferential surface of the inner stationary cylinder 9 and the smooth lands 13 on the inner circumferential surface of the rotatable cylinder 14 jointly define a gap 18 therebetween.

The outer stationary cylinder 3 has an inlet port 19 defined in the upper end thereof for connection to a device which is to be evacuated. A gas discharged from the device flows through the inlet port 19, the gap 17, the gap 18, and the discharge holes 6 into an outlet port 20 defined in the base 21.

When the motor is energized, the rotor shaft 16 and hence the rotatable cylinder 14 rotate under magnetic forces developed by the stator 7 and the rotor 15. The gas drawn from the inlet port 19 is introduced into the helical groove 1 in the inner circumferential surface of the outer stationary cylinder 3. While the rotatable cylinder 14 is rotating relatively to the outer stationary cylinder 3, the gas in the helical groove 1 is compressed progressively downwardly, and then introduced into the helical groove 4 in the outer circumferential surface of the inner stationary cylinder 9 and flows progressively upwardly along the helical groove 4. Finally, the gas flows through the discharge holes 6 and is discharged from the vacuum pump through the outlet port 20.

As the gas flows more closely toward the outlet port 20, the pressure exerted to the gas becomes higher, tending to force more gas to leak through the gaps 17, 18. However, any such gas leakage is minimized by the smooth lands 11, 13 on the outer and inner circumferential surfaces of the rotatable cylinder 14. The rows of recesses 10, 14 are effective to generate turbulent flows in the gas in the helical grooves 1, 4, increasing the rate at which the gas flows in the helical grooves 1, 4, so that actual gas leakage is compensated for by gas flows at the increased rate. Therefore, the vacuum pump effectively operates in a high gas pressure range.

As shown in FIG. 3, any gas leakage through the gaps 17, 18 is also minimized by selecting dimensions of the recesses 10 and the helical thread 2 as follows: The recesses 10 have a maximum length L1 transversely across the helical thread 2, and the helical thread 2 has a transverse width L2. The maximum length L1 is smaller than the transverse width L2. Therefore, any adjacent turns of the helical groove 1 are held out of communication with each other through the recesses 10, so that no gas flows or leaks between adjacent turns of the helical groove 1 through the recesses 10. The recesses 12 in the inner circumferential surface of the rotatable cylinder 14 and the helical thread 5 on the outer circumferential surface of the inner stationary cylinder 9 are also dimensionally related to each other in the same manner as shown in FIG. 3.

The rows of recesses 10, 12 and the smooth lands 11, 13 may be annular in shape, as shown, or helical in shape. Each of the outer and inner stationary cylinders 3, 9 may have two or more helical grooves depending on the vacuum to be developed by the vacuum pump or the rate at which the gas is to be discharged by the vacuum pump. In the illustrated embodiment, the outer stationary cylinder 3 actually may have two helical grooves 1 defined in the inner circumferential surface thereof.

Although a certain preferred embodiment has been shown and described, it should be understood that many changes and modifications may be made therein without departing from the scope of the appended claims.

What is claimed is:

1. A vacuum pump comprising:

a rotatable cylinder, said rotatable cylinder having a plurality of axially spaced annular rows of recesses defined in an outer circumferential surface thereof and a plurality of axially spaced smooth lands on said outer circumferential surface thereof, said rows of recesses and said smooth lands alternating with each other;

an outer stationary cylinder disposed coaxially around said rotatable cylinder and having a helical groove defined in an inner circumferential surface thereof;

an inner stationary cylinder disposed coaxially in said rotatable cylinder and having a helical groove defined in an outer circumferential surface thereof and a helical thread on the outer circumferential surface thereof;

said recesses having an axial length smaller than a transverse width of said helical thread; and means for rotating said rotatable cylinder to move a gas along said helical grooves.

2. A vacuum pump comprising:

a rotatable cylinder having a plurality of axially spaced annular rows of recesses defined in an outer circumferential surface thereof and a plurality of axially spaced smooth lands on said outer circumferential surface thereof, said rows of recesses and said smooth lands alternating with each other;

an outer stationary cylinder disposed coaxially around said rotatable cylinder and having a helical groove defined in an inner circumferential surface thereof and a helical thread on the inner circumferential surface thereof;

said recesses having an axial length smaller than a transverse width of said helical thread;

an inner stationary cylinder disposed coaxially in said rotatable cylinder and having a helical groove defined in an outer circumferential surface thereof; and means for rotating said rotatable cylinder to move a gas along said helical grooves.

3. A vacuum pump comprising:

a rotatable cylinder, said rotatable cylinder having a plurality of recesses defined in both inner and outer circumferential surfaces thereof;

an outer stationary cylinder disposed coaxially around said rotatable cylinder and having a helical groove defined in an inner circumferential surface thereof;

an inner stationary cylinder disposed coaxially in said rotatable cylinder and having a helical groove defined in an outer circumferential surface thereof; and means for rotating said rotatable cylinder to move a gas axially along said helical grooves.

4. A vacuum pump according to claim 1, wherein said outer stationary cylinder is of a conical shape, said outer circumferential surface of said rotatable cylinder being of a conical shape complementary to the conical shape of the outer stationary cylinder.

* * * * *